US011221163B2

(12) United States Patent
Lefor et al.

(10) Patent No.: US 11,221,163 B2
(45) Date of Patent: Jan. 11, 2022

(54) EVAPORATOR HAVING INTEGRATED PULSE WAVE ATOMIZER EXPANSION DEVICE

(71) Applicants: Randy Lefor, Phoenix, AZ (US); Jeff Roller, Phoenix, AZ (US)

(72) Inventors: Randy Lefor, Phoenix, AZ (US); Jeff Roller, Phoenix, AZ (US)

( * ) Notice: Subject to any disclaimer, the term of this patent is extended or adjusted under 35 U.S.C. 154(b) by 76 days.

(21) Appl. No.: 16/529,787

(22) Filed: Aug. 2, 2019

(65) Prior Publication Data

US 2021/0033317 A1 Feb. 4, 2021

(51) Int. Cl.

| | |
|---|---|
| ***F25B 39/02*** | (2006.01) |
| ***F25B 5/02*** | (2006.01) |
| ***F25B 41/31*** | (2021.01) |
| *F25D 21/06* | (2006.01) |
| *F25B 40/02* | (2006.01) |
| *F25B 41/20* | (2021.01) |

(52) U.S. Cl.

CPC ..... *F25B 39/028* (2013.01); *F25B 5/02* (2013.01); *F25B 41/31* (2021.01); *F24F 2221/28* (2013.01); *F25B 40/02* (2013.01); *F25B 41/20* (2021.01); *F25B 2341/0012* (2013.01); *F25B 2600/2513* (2013.01); *F25B 2600/2521* (2013.01); *F25D 21/06* (2013.01); *F25D 2317/06* (2013.01)

(58) Field of Classification Search

CPC ..... F25B 2341/0012; F25B 39/028; F25B 39/02; F25B 2339/021; F25B 2339/0241; F25B 2339/02; F25B 40/02; F25B 41/42; F25B 41/48; F25B 41/22; F25B 5/02; F25B 41/31; F28F 9/0273; H05K 7/02345; B05B 1/20; B05B 1/202; B05B 1/205

USPC ..... 165/115, 142

See application file for complete search history.

(56) References Cited

U.S. PATENT DOCUMENTS

| | | | | |
|---|---|---|---|---|
| 3,390,540 A | | 7/1968 | Brush | |
| 4,807,449 A | * | 2/1989 | Helmer | F25B 40/00 62/503 |
| 4,995,243 A | | 2/1991 | Ward | |
| 5,272,884 A | | 12/1993 | Cur et al. | |

(Continued)

FOREIGN PATENT DOCUMENTS

| | | | | |
|---|---|---|---|---|
| JP | 62131199 A | * | 6/1987 | F28F 9/027 |
| WO | WO-2011023192 A2 | * | 3/2011 | F25B 40/00 |
| WO | 2012168544 A1 | | 12/2012 | |

OTHER PUBLICATIONS

Translation of Masataka (Year: 1987).*

(Continued)

*Primary Examiner* — Marc E Norman

(74) *Attorney, Agent, or Firm* — Allen F. Bennett; Bennett Intellectual Property

(57) ABSTRACT

An evaporator for use in a refrigeration system includes one or more Coanda evaporation chambers having an integrated, internal expansion device. The internal expansion device is a linear atomization tube having a plurality of ejection holes arranged in a series of spiral rows. Liquid refrigerant introduced into the linear atomization to is ejected onto the inner wall of the Coanda evaporation chamber, covering it completely with a thin layer of liquid refrigerant. Liquid refrigerant is fed to the linear atomization device in a series of rapid pulses.

9 Claims, 6 Drawing Sheets

(56) References Cited

U.S. PATENT DOCUMENTS

| | | | | |
|---|---|---|---|---|
| 5,428,966 | A | 7/1995 | Alsenz | |
| 5,507,340 | A | 4/1996 | Alston | |
| 6,672,091 | B1 * | 1/2004 | Lefor | F25B 41/31 62/223 |
| 7,159,407 | B2 * | 1/2007 | Chen | F25B 1/00 62/100 |
| 7,409,985 | B2 | 8/2008 | Biasiotto et al. | |
| 7,841,208 | B2 | 11/2010 | Lefor | |
| 10,054,344 | B2 | 8/2018 | Ito et al. | |
| 10,288,329 | B2 * | 5/2019 | Su | F25B 39/028 |
| 2010/0242535 | A1 * | 9/2010 | Jianlong | F25B 39/028 62/524 |
| 2011/0042047 | A1 * | 2/2011 | Karl | F28F 17/005 165/115 |
| 2012/0096882 | A1 | 4/2012 | Yang | |
| 2012/0247740 | A1 * | 10/2012 | Gertner | F28D 9/0093 165/148 |
| 2013/0086930 | A1 * | 4/2013 | Scherer | F25B 1/00 62/115 |
| 2015/0075204 | A1 * | 3/2015 | Brodie | B60H 1/00335 62/324.6 |
| 2018/0299172 | A1 * | 10/2018 | Hartfield | F25B 39/028 |

OTHER PUBLICATIONS

Wikipedia contributors. (Jan. 14, 2021). Coanda effect. In Wikipedia, The Free Encyclopedia. Retrieved 14:39, Mar. 15, 2021, from https://en.wikipedia.org/w/index.php?title=Coand%C4%83_effect&oldid=1000333406 (Year: 2021).*

* cited by examiner

Fig. 1
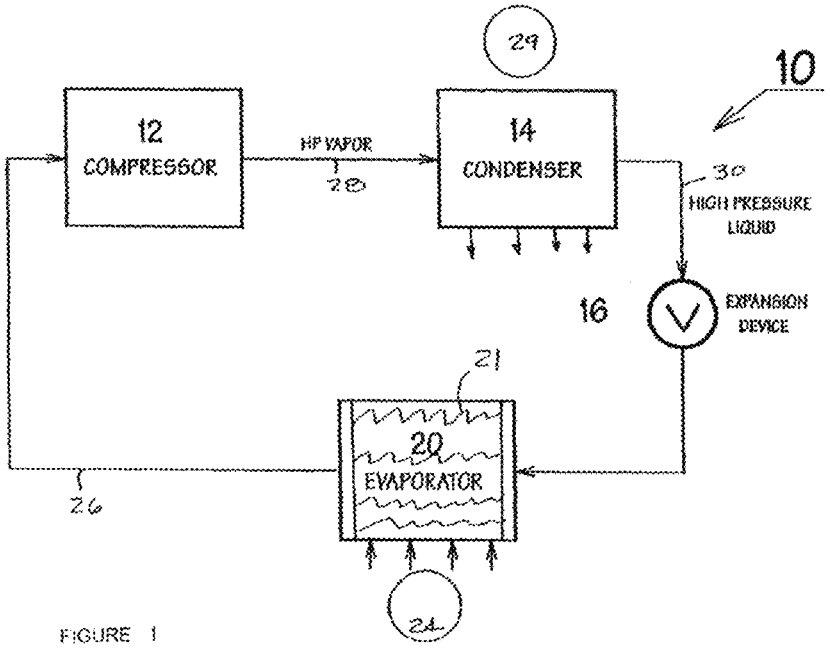
FIGURE 1
(PRIOR ART)
Fig. 2
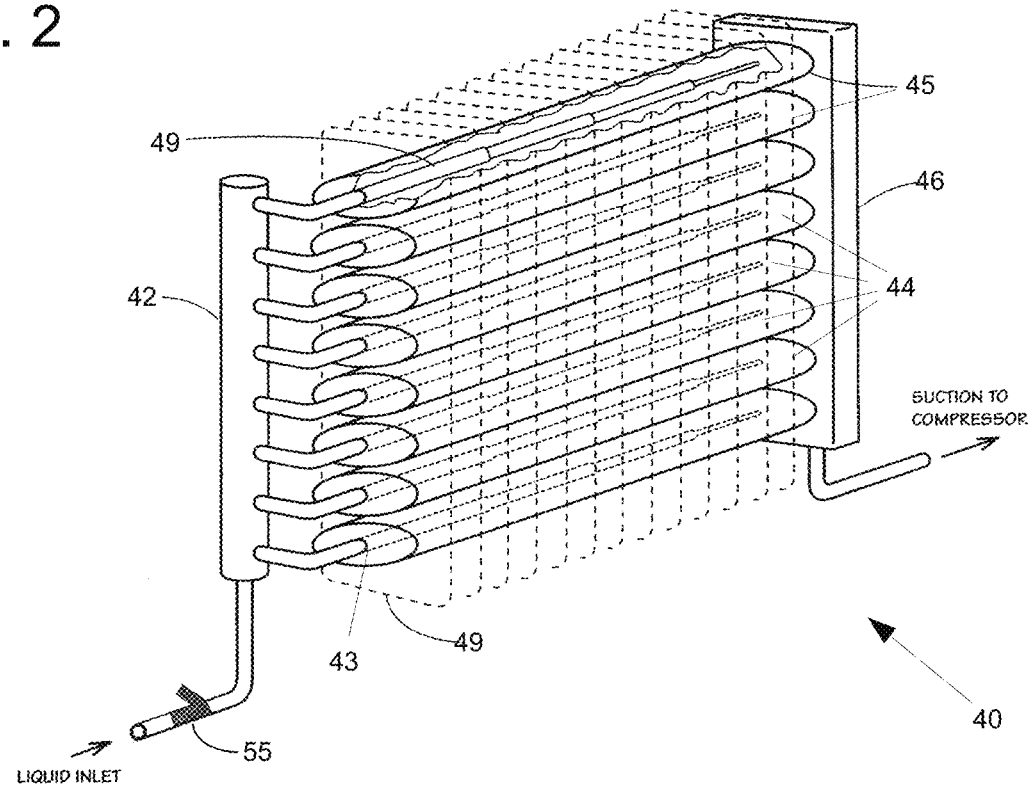

EVAPORATOR HAVING INTEGRATED PULSE WAVE ATOMIZER EXPANSION DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to an evaporator for a refrigeration system. More particularly, the invention relates to an evaporator having an Coanda effect inducing evaporation chambers and an integrated expansion device using pulse wave atomization of refrigerant to improve the efficiency of the evaporator.

Description of the Related Art

Cooling and refrigeration have been extremely important for many years. Although there are a many types of refrigeration systems, most operate on a compression/evaporation cycle. Nearly every refrigeration device includes a circuit having four common elements—a compressor, a condenser, an expansion device, and an evaporator. A refrigerant constantly cycles through the four elements of the circuit. Air or water within an enclosed refrigerator system is moved across the evaporator, transferring heat to the refrigerant. Ambient air or water in outside refrigerator system is moved across the condenser, transferring heat from the refrigerant to the external ambient air or water. A compressor and expansion device upstream from the condenser and evaporator, respectively, are used to modulate pressure within different regions of the refrigeration circuit. There are a variety of refrigeration or cooling systems in use, but they all operate upon the same basic principles.

FIG. 1 shows the four parts of the refrigeration system 10. The compressor 12 receives superheated vapor refrigerant from the evaporator 20 via conduit 26 and compresses the superheated vapor into a high pressure vapor which travels through conduit 28 and enters the condenser 14. In the condensor 14 heat is removed from the vapor, causing it to condense into a high pressure liquid 30. Heat exchange in the condenser is usually assisted by a fan 29 blowing ambient air or liquid across the condenser 14. High pressure liquid travels through conduit 30 and enters an expansion device 16. The expansion device 16 modulates flow, lowering the pressure (i.e. expansion) of the liquid, which then travels to the evaporator 20, which may include one or more evaporator coils 21. A fan 24 facilitates heat exchange, transferring heat to the refrigerants within the evaporator 20. In the evaporator 20, the liquid refrigerant absorbs heat and converts again into a superheated vapor which then enters the compressor 26 and the cycle continues.

In theory, the entire refrigerant leaves the evaporator as a superheated gas/vapor and moves through the compressor where the vapor is condensed to a liquid before traveling to the condensor. The liquid refrigerant leaves the condenser and enters the expansion device where its temperature and pressure are lowered, but the refrigerant remains a liquid form until it enters the evaporator and absorbs enough heat to evaporate. In most evaporators, a liquid refrigerant expands into the evaporator and the liquid eventually evaporates or changes state from a liquid to a saturated liquid/vapor then to a superheated vapor. The liquid change of state to vapor provides the most cooling (latent heat). When all of the liquid refrigerant boils off in the evaporator, it still needs to be superheated (ten degrees in most applications). The superheated vapor then exits the evaporator and enters the compressor.

Refrigeration systems require a restriction of flow of the refrigerant prior to entering the evaporator in order to maintain the proper boiling temperature for that particular application. The first metering devices were manually controlled valves that needed to be adjusted to meet the load requirements. These devices require someone to manually adjust the valve every time there is a shift in the heat load of the evaporator.

Ideally, the expansion device only lowers the pressure of the liquid refrigerant. One common problem is that of a flash gas forming before the liquid enters the evaporator 20. This reduces the system's efficiency and can increase superheating in the evaporator. Therefore, there are numerous devices in the prior art intended to minimize the formation of a flash gas. However, this remains a significant problem in the industry.

Another common problem is pooling of the refrigerant in the evaporator. In the right conditions, refrigerant rays at a temperature at or above its boiling point may nonetheless remain in liquid form, but superheated. Modern refrigerants often have higher boiling points, making this a more pressing concern. Typically, liquid refrigerant is heated within the evaporator and/or prime to reaching the compressor at least 10° above its boiling point.

The newer refrigerants (having high heat of vaporization) require even larger evaporators to compensate for what are often called "lazy" refrigerants. These refrigerants are forced through an uphill pattern of flow in the evaporator. This minimizes the risk of liquid entering the compressor, but creates other problems such as oil clogging and pressure drop in the system. The long, serpentine circuits used with newer refrigerants create more opportunities for oil stagnation throughout the circuit, leading to clogging and oil insulation.

Another common problem in modern refrigeration systems is the gumming, clogging and insulating effects of oil-based lubricants used in refrigeration systems. The lubricants are co-mingled with the refrigerant throughout the circuit. Flash gas created in the expansion device and pooling of refrigerant within the evaporator can exacerbate these problems. There are also several methods explained in the prior art designed to alleviate these problems.

In addition, the evaporator's in general tend to be in efficient. Liquid refrigerant, when pooled, requires longer periods of time to evaporate. Fins may be added to the evaporator coils, but that alone does not cure the problem. Increased efficiency within the evaporator requires increased total surface area for heat transfer between the walls of the evaporator circuit and the refrigerant.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide devices for use in refrigeration systems that maximize the efficiency of the expansion device and the evaporator.

BRIEF SUMMARY OF THE INVENTION

Disclosed is an evaporator for a refrigeration system having an internal atomizer which ejects refrigerant expansion droplets, or particles, simultaneously, coating the wall of the evaporator where heat exchange occurs. The liquid refrigerant particles can be as small as 100 micron in diameter, and are distributed evenly over the inner wall of the evaporator. The evaporator includes one or more elliptic cylinder evaporator chambers that may be used with any common refrigerant, regardless of boiling point, including CO2. The evaporator efficiently expands, i.e. evaporates the liquid refrigerant, by spraying pulses of refrigerant particles evenly across the heat exchange surface of the evaporator. The evaporator produces little or no pressure drop. The pulsed impinging of particles on the inner wall of the evaporator also serves to remove any lubricating oil accumulated on the wall. The elliptic cylinder shape of the evaporator chamber provides upwards of 80% laminar air flow, further improving heat exchange.

In one embodiment, refrigerant enters the inlet manifold and sprays a pulse wave expansion of high quality refrigerant through a linear atomization tube directly onto the inner wall of a Coanda evaporation chamber in a predetermined pattern. Each linear atomization tube has the nature of a throttle (flow control) by a pulse wave expansion device in conjunction with the linear atomization tube consisting of an array of thousands of 100 micron sized or smaller holes with equal, spiral, spacing. The tubes perform the function of the expansion device, only now there are thousands of pulse wave expansion particles evenly distributed to the inner wall of the evaporator chamber. The thousands of pulse wave expansion devices insure that refrigerant enters each evaporator chamber in the form of droplets of 100 microns or less. This linear pulse wave expansion device with a directional spray array provides a direct refrigerant spray pattern to the entire inner wall surfaces. This pulse wave expansion of refrigerant vaporizes instantly as it contacts the entire area of the inner wall of the evaporator. An additional effect of this pulse wave refrigerant spray distribution system is to scrub and emulsify refrigerant oils off the inner evaporator walls continuously which prevents oil clogging and oil insulating effects typically found in existing evaporator designs. The vapor is now removed and the oil exits at the lowest point of the evaporation chamber.

One object of the invention is to provide an evaporator with an internal atomizer that is simple, inexpensive, reliable, and easy to operate and maintain.

Another object of the invention is to improve evaporator performance using an integrated pulse wave expansion device to increase the rate of evaporation, prevent pooling of the refrigerant, reduce pressure drop, and to prevent oil logging or insulating, thus increasing the efficiency of the said evaporator.

Another object of the invention is to provide an evaporator chamber that induces a Coanda effect on air blown across the evaporator chamber to improve laminar flow and heat exchange of the chamber.

Another object of the present invention is to provide a method of sub cooling, i.e. cooling liquid refrigerant before it enters the evaporator.

Another object of the invention is to provide an elliptic evaporator chamber that increases laminar flow by inducing a Coanda effect.

Another objects of the invention is to improve evaporator performance by having no oil clogging or insulating effects inside of the evaporator. The evaporator is suitable for use with existing refrigerator systems. As the load increases the pulse wave increases, as the load decreases the pulses decrease. The invention can be applied to cool air, water, glycol, and CO2.

Another object of the invention is to provide a method of cooling liquid refrigerant before it enters the evaporator (sub cooling).

Another object of the invention is to provide an evaporator and thousands of atomized expansions simultaneously, improving the refrigeration method or process which is simple, inexpensive, reliable, and easy to use. The LRAD requires a final filter of 2-microns.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 is a diagram of a typical prior art refrigeration system;

FIG. 2 is a perspective view of an evaporator for a refrigeration system in accordance with the principles of the invention;

DETAILED DESCRIPTION

Figure 3:
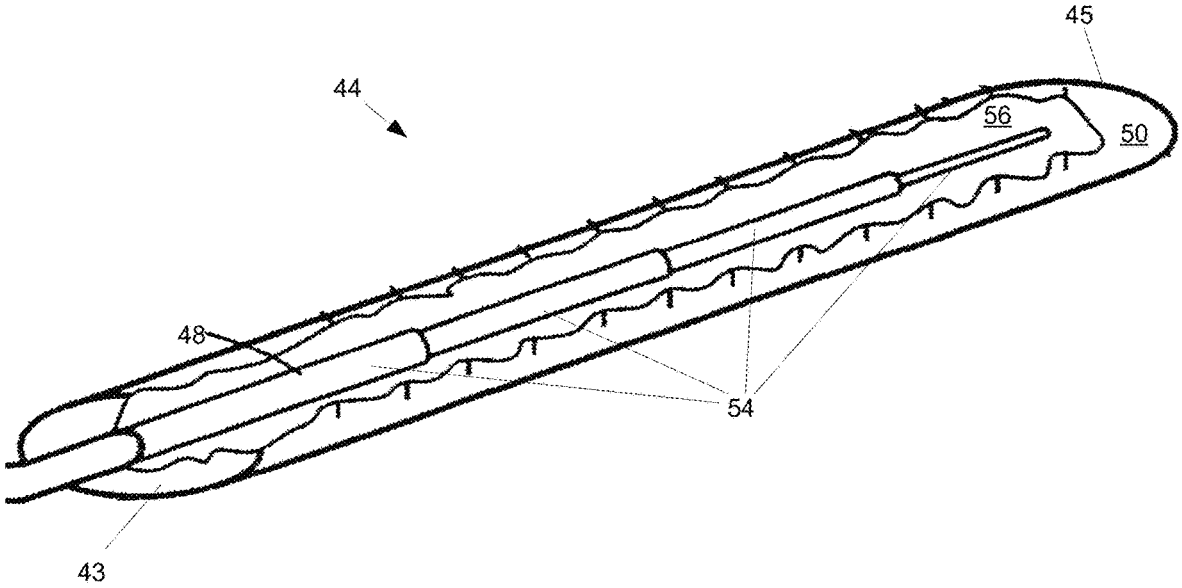
FIG. 3 is a cutaway view of a Coanda evaporation chamber in accordance with principles of the invention.
Figure 4:
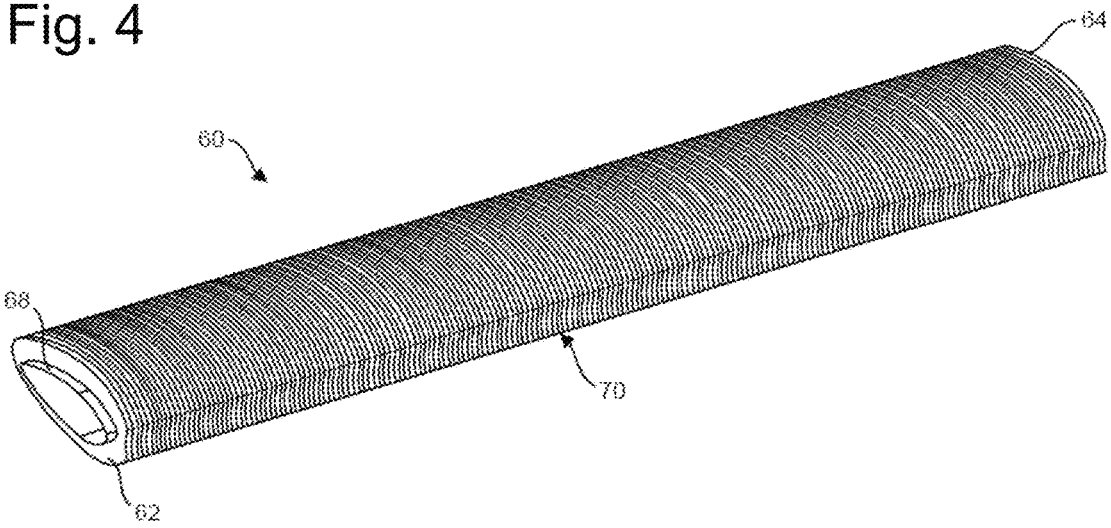
FIG. 4 is a perspective view of an alternative embodiment of a Coanda evaporation chamber in accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

As used herein, unless otherwise indicated, either explicitly or implicitly due to the context, the term "Coanda evaporation chamber" refers generally to an elongate evaporation chamber having a cross-sectional shape that induces a Coanda effect on a fluid passing over the outside of the evaporation chamber in a direction parallel to the cross-section and perpendicular to the length of the evaporation chamber. The evaporator chamber may have a pure elliptic cross-section or a cross-section of an ellipse where one or both ends of the ellipse or pointed, a cross-sectional shape of an airfoil, or other configuration improving laminar airflow by means of a Coanda effect. The length of a Coanda evaporation chamber may be substantially straight, curved or serpentine as is known in the art.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

The expansion device in accordance with the principles of the invention, instead of being upstream from the evaporation chamber is integrated into the evaporation chamber and comprises an atomization system. One atomization system in accordance with the principles of the invention may be referred to as an LRAD (Linear Refrigerant Atomizer Design), and is formed from a tube inside a Coanda evaporation chamber extending along the length of the evaporation chamber and positioned substantially centrally within the evaporation chamber. The linear atomization tube in accordance with the principles of the invention provides an improved rate of heat transfer in the evaporation chamber by atomizing the refrigerant into small droplets, or particles, and spraying them evenly onto the inner wall of the evaporator chamber. As a result, substantially all of refrigerant vaporizes almost instantly upon contact with the inner wall. This saturated vapor then (expansion) leaves the evaporator as a vapor, which is not necessarily superheated.

FIGS. 2 and 3 shows an exemplary evaporator 40 in accordance with the principles of the invention having an inlet manifold 42 which distributes liquid refrigerant into eight identical Coanda evaporation chambers 44. The Coanda evaporation chambers 44 of this embodiment are elliptic cylinders, as opposed to circular cylinders, and are substantially straight along their lengths which extend from a proximal end 43 connected to the inlet manifold 42 to a distal end 45 connected to the outlet manifold 46. The eight Coanda evaporation chambers 44 of this embodiment are connected to a plurality of cooling fins 49 aligned perpendicular to the lengths of Coanda evaporation chambers 44. In this embodiment, the cooling fins 49 are attached to all eight of the Coanda evaporation chambers 44. The inlet manifold 42 may include internal valves, not shown, for regulating flow into the Coanda evaporation chambers 44. When the load on a refrigeration system is low, the inlet manifold 42 may feed refrigerants to only a few or one of the Coanda evaporation chambers 44. If the load increases, the inlet manifold 46 may feed refrigerant to more or all Coanda evaporation chambers 44. The Coanda evaporation chambers 44 may be aligned substantially horizontally, or may be tilted such that their distal ends 45 are higher than their proximal ends 43, or vice versa.

A pulse wave injector 55 receives liquid refrigerant from a typical condenser upstream from the evaporator 40. The pulse wave injector 55 feeds liquid refrigerant to the inlet manifold 42 which then distributes the pulsed liquid refrigerant into the linear refrigerant atomization tubes 48 which are centrally positioned inside each of the Coanda evaporation chambers 44. In this embodiment, each of the linear refrigerant atomization tubes 48 comprises a plurality of sequentially smaller sections having progressively smaller radii and are shown in more detail in FIG. 3. Each of the linear refrigerant atomization tubes 48 has several small holes arranged in a spiral pattern along the entire length of the atomizer 48. The holes may be as small as 100 microns in diameter and may be formed by laser drilling or other techniques. Refrigerant is ejected evenly through the holes of the spray pattern of the atomizer 48, forming droplets, or particles, of liquid refrigerant. The spray pattern of the ejected particles substantially completely coats the inside walls of the evaporator chambers 44 with a thin sheet of liquid refrigerant. This thin sheet of liquid refrigerant evaporates substantially instantaneously into a vapor that then travel from the Coanda evaporation chambers 44 to the outlet manifold 46, and proceed to a compressor as with standard existing refrigeration systems.

The spray patterns of the linear refrigerant atomization tubes 48 substantially maximize heat transfer between the refrigerant and an ambient fluid flowing over the Coanda evaporation chambers 44. The inventors have found that this refrigerant evaporation process is improved by supplying liquid refrigerant to the atomization tubes 48 in a series of pulsed waves provided by the pulse wave injector 55. Supplying liquid refrigerant in a series of rapid pulses allows all of the liquid refrigerant from one pulse to evaporate off the inner wall 56 of the Coanda evaporation chambers 44 prior to receiving a second coating from a subsequent pulse. This prevents pooling or collecting of refrigerant within the evaporator chamber 44. Thus, applying liquid refrigerant particles to the inner wall 56 in pulse waves improves the efficiency of vaporization, generally eliminating the need to superheat the evaporator. In addition, the rapid pulsing impinging of liquid refrigerant against the inner wall 56 removes lubricating oils that otherwise accumulate on the inner wall 56, thus reducing or eliminating the insulating effect caused by accumulated oil on the inner wall 56.

FIG. 3 shows a cutaway view of a single Coanda evaporation chamber 44 of the evaporator 40 shown in FIG. 2. The Coanda evaporation chamber 44 extends from its proximal end 43 to the distal end 45. During use, a fluid such as air or water flows across and impinges the outer wall 50. The linear atomization tube 48 extends from the inlet manifold 42, through the proximal end 43 and extends distally toward the distal end 45 through the center of the Coanda evaporation chamber 44. The linear atomization tube 48 has a multitude of small ejection holes (not shown), as small as 100μ in diameter or smaller. Liquid refrigerant enters the linear atomization tube 48 from the inlet manifold 42 in a series of pulsed waves. The linear atomization tube 48 has a decreasing cross-sectional area as it travels through the Coanda evaporation chamber toward the distal end 43. In the embodiment shown in FIG. 3, the linear atomization tube 48 comprises four sections 54, each progressively smaller. Linear atomization tube 48 is cylindrical and each section 54 has a progressively smaller radius in the distal direction. Those skilled in the art will appreciate that this results in the liquid refrigerant reach each of the ejection holes at substantially the same pressure. This allows the linear atomization tube 48 to coat the inner wall 56 substantially evenly along the entire length of the Coanda evaporation chamber 44. Each Coanda evaporation chamber 48 has openings in its distal end 45 that allows both vaporized refrigerant and lubricating oil to exit the chamber.

Figure 5:
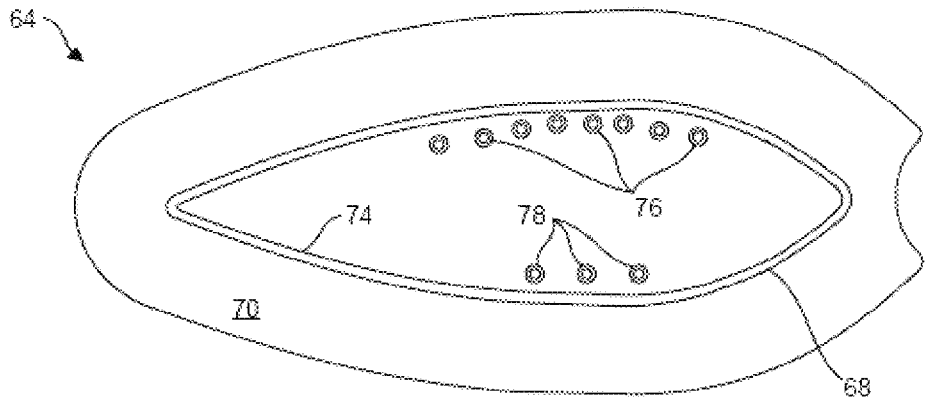
FIG. 5 is a plan view of a distal end of an alternative embodiment of a Coanda evaporation chamber in accordance with the principles of the invention.
Figure 6:
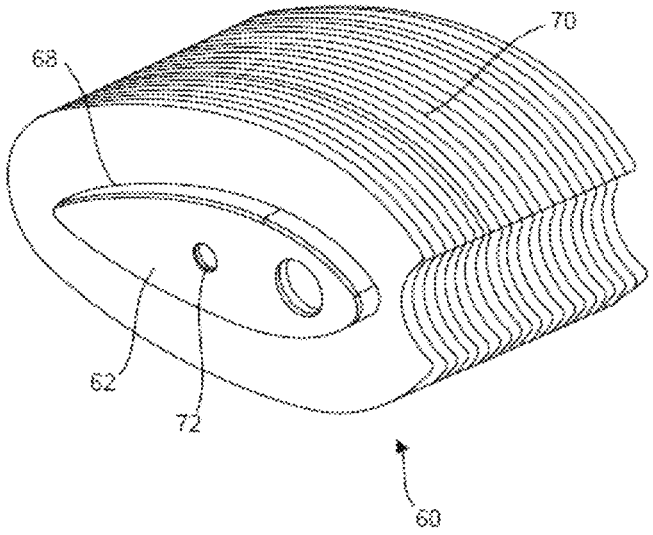
FIG. 6 is a perspective view of an alternative embodiment of a Coanda evaporation chamber in accordance with principles of the invention.
Figure 7:
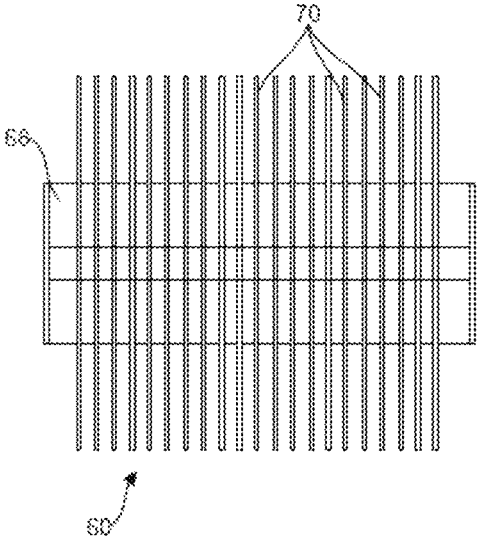
FIG. 7 is a front elevation view of an alternative embodiment of a Coanda evaporation chamber in accordance with principles of the invention.

FIGS. 4-7 show an alternative embodiment of a Coanda evaporation chamber 60. Coanda evaporation chamber 60 is substantially straight and has a length defined by a proximal end 62 and a distal end 64. Coanda evaporation chamber 60 has a cross-sectional shape of an ellipse that is pointed on each end, i.e. an airfoil shape. Coanda evaporation chamber 60 has an outer surface 68 having a plurality of fins 70 that are perpendicular to its length. Refrigerant ejected from a linear atomization to evenly coats the and are wall 74 before evaporating. FIG. 5 shows the distal end 64. A plurality of vapor outlet holes 76 are located in the distal end 64 near the top of the Coanda evaporation chamber 60, and a plurality of oil outlet holes 78 lie near the bottom of the chamber 60 in the distal end 64. In this embodiment, there are eight vapor outlet holes 76 and three oil outlet holes 78. There is an opening 72 and the proximal end 62 for receiving a linear atomization tube, as shown in FIG. 6.

Figure 8:
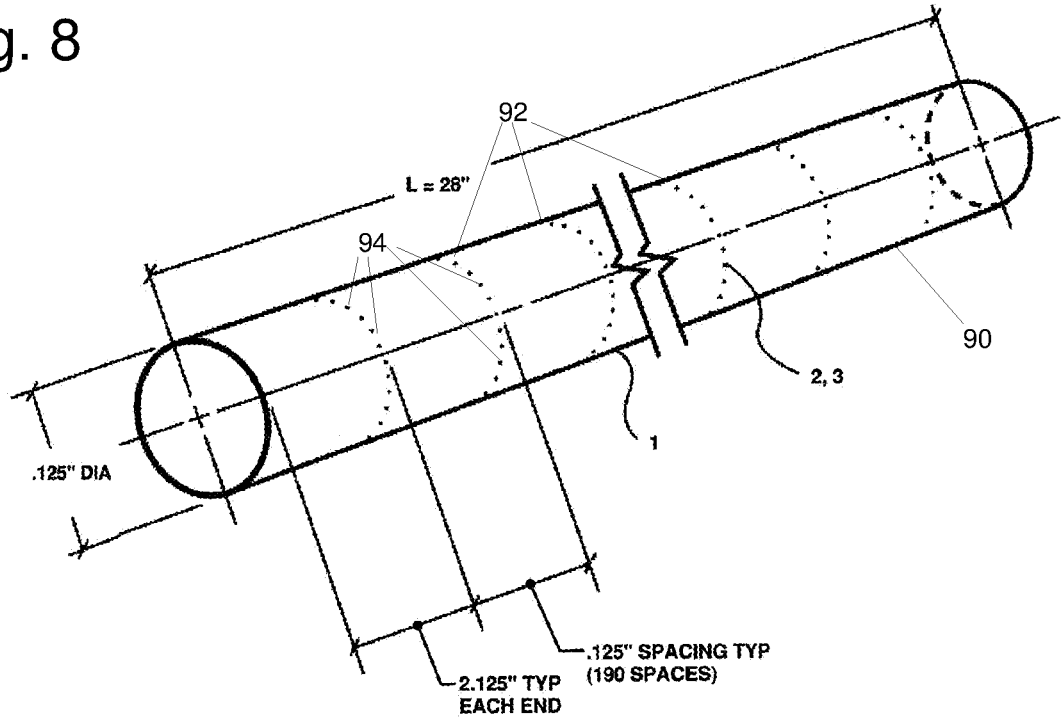
FIG. 8 is a perspective view of a linear atomization tube in accordance with principles of the invention.

FIG. 8 shows a linear atomization tube 90 that is cylindrical in shape and includes several rows 92 of ejection holes 94 along the length of the tube 90. In this embodiment, the linear atomization tube 90 has a diameter of 0.125" and the rows 92 are spaced 0.125" apart. Each row 92 includes 24 ejection holes 94, each 100 microns wide and spaced 15° apart. Each ejection holes 94 of each successive row 92 has holes that are 7.5° rotated from the orientation of the holes of the previous row. This creates a spiral pattern that helps to ensure an even distribution of ejected refrigerant particles across the inner wall of a Coanda ejection chamber.

Figure 9:
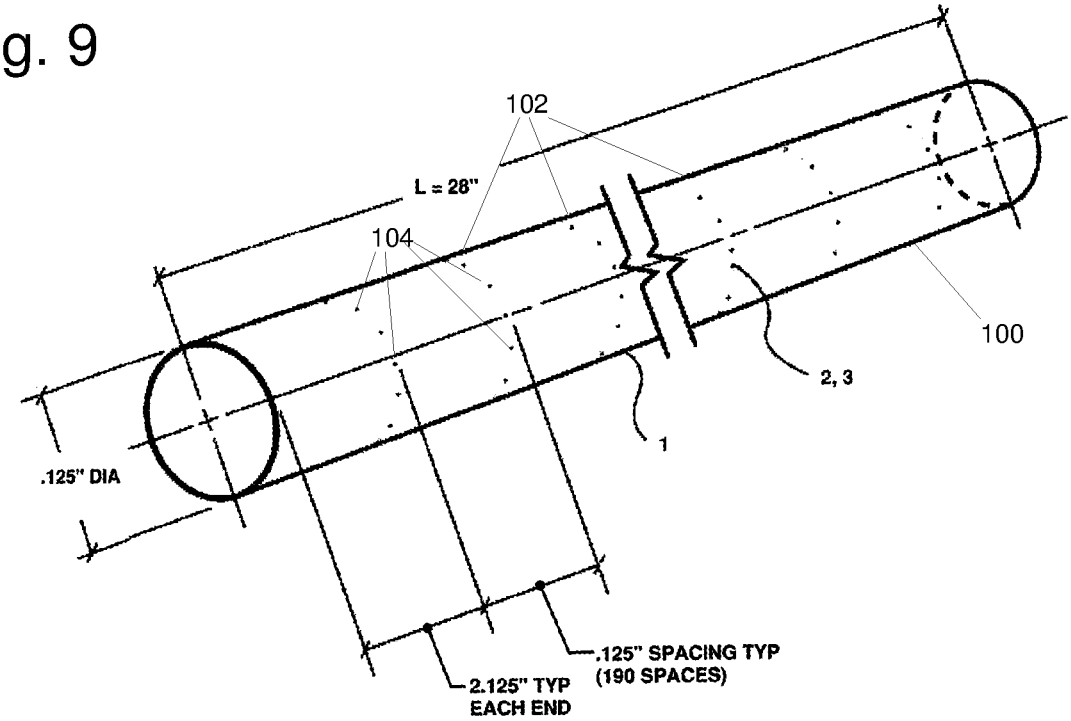
FIG. 9 is a perspective view of an alternative embodiment of a linear atomization tube in accordance with the principles of the invention.

FIG. 9 shows an alternative embodiment of a linear atomization tube 100 that is cylindrical in shape and includes several rows 102 of ejection holes 104 along the length of the tube 100. In this embodiments, the linear atomization tube 100 has a diameter of 0.125" and the rows 102 are spaced 0.125" apart. Each row 102 includes 12 ejection holes 94, each 100 microns wide and spaced 30° apart. Each ejection holes 104 of each successive row 102 has holes that are 15° rotated from the orientation of the holes of the previous row. This creates a spiral pattern that helps to ensure an even distribution of ejected refrigerant particles across the inner wall of a Coanda ejection chamber.

During use, refrigerant enters the inlet manifold and sprays a pulse wave expansion of high quality refrigerant through a linear atomization tube directly onto the inner wall of a Coanda evaporation chamber in a predetermined pattern. Each linear atomization tube has the nature of a throttle (flow control) by a pulse wave expansion device in conjunction with the linear atomization tube consisting of an array of thousands of 100 micron sized or smaller holes with equal, spiral, spacing. The tubes perform the function of the expansion device, only now there are thousands of pulse wave expansion particles evenly distributed to the inner wall of the evaporator chamber. The thousands of pulse wave expansion devices insure that refrigerant enters each evaporator chamber in the form of droplets of 100 microns or less. This linear pulse wave expansion device with a directional spray array provides a direct refrigerant spray pattern to the entire inner wall surfaces. This pulse wave expansion of refrigerant vaporizes instantly as it contacts the entire area of the inner wall of the evaporator. An additional effect of this pulse wave refrigerant spray distribution system is to scrub and emulsify refrigerant oils off the inner evaporator walls continuously which prevents oil clogging and oil insulating effects typically found in existing evaporator designs. The vapor is now removed and the oil exits at the lowest point of the evaporation chamber.

The linear atomization tube in accordance with the principles of the invention provides a wetted spray of 100-micron or less sized particles of refrigerant perpendicularly and directly onto the inside wall of the evaporator chamber. These micro sized particles tend to keep from combining to form larger globules of solid liquid, which immensely improves the rate of evaporation. This is an advantage with the newer environmentally friendly refrigerants having high boiling points. Evaporators have also increased surface area to compensate for these environmentally friendly Refrigerant replacements.

Optionally, the distal end of the Coanda evaporation chamber can be angled downward as much as thirty degrees, to assist oil droplets to exit the evaporation chamber and return to the compressor. This Coanda evaporation chamber and integrated linear atomization tube also does not require superheating at the outlet of the evaporator, only a minimum superheat at the inlet of the compressor. The superheat at the compressor is maintained by a pressure regulating control valve (mechanical or electronic) mounted on the liquid line at the inlet of the liquid manifold. Another flow control device is an electronic pulsating injector mounted prior to each individual LRAD tube, or a single pulsating injector to all the circuits on the manifold. The control method could also be a combination of both, an electronic pressure regulating and pulse wave device. The vapor of the refrigerant after evaporation leaves the evaporation chamber through a predetermined amount of holes in the upper portion of each oval chamber, or a single outlet (pipe fitting) that can or may be pulled from one or both ends of the evaporator. The oil escapes through holes on the lower portion of the oval chamber.

Figure 10:
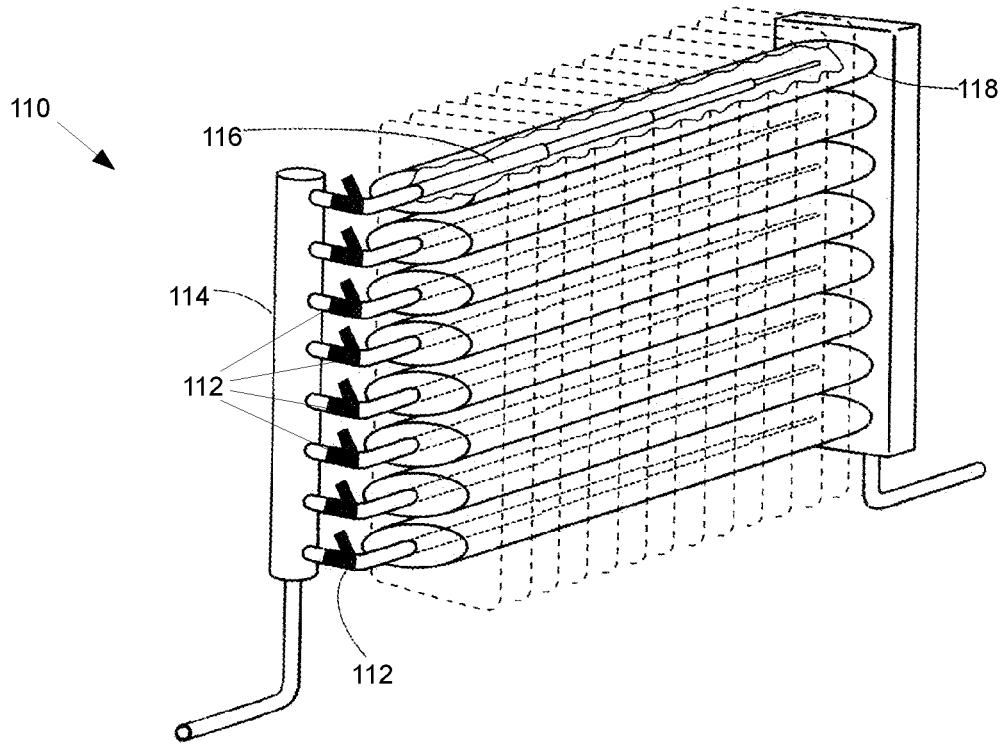
FIG. 10 is a perspective view of another alternative embodiment of an evaporator for a refrigeration system in accordance with the principles of the invention.

FIG. 10 shows an alternative embodiment of an evaporator 110 in accordance with the principles of the invention. In this embodiment, a pulse wave control 112 is positioned between the inlet manifold 114 and each individual linear atomization tube 116 for each individual Coanda evaporation to 118. This provides more precise control and can lead to increased overall evaporator efficiency. This type of control also enables an individual Coanda evaporation chamber 118 to defrost without stopping the refrigeration process of the remaining evaporation chambers. This is crucial in medium temperature food storage.

Figure 11:
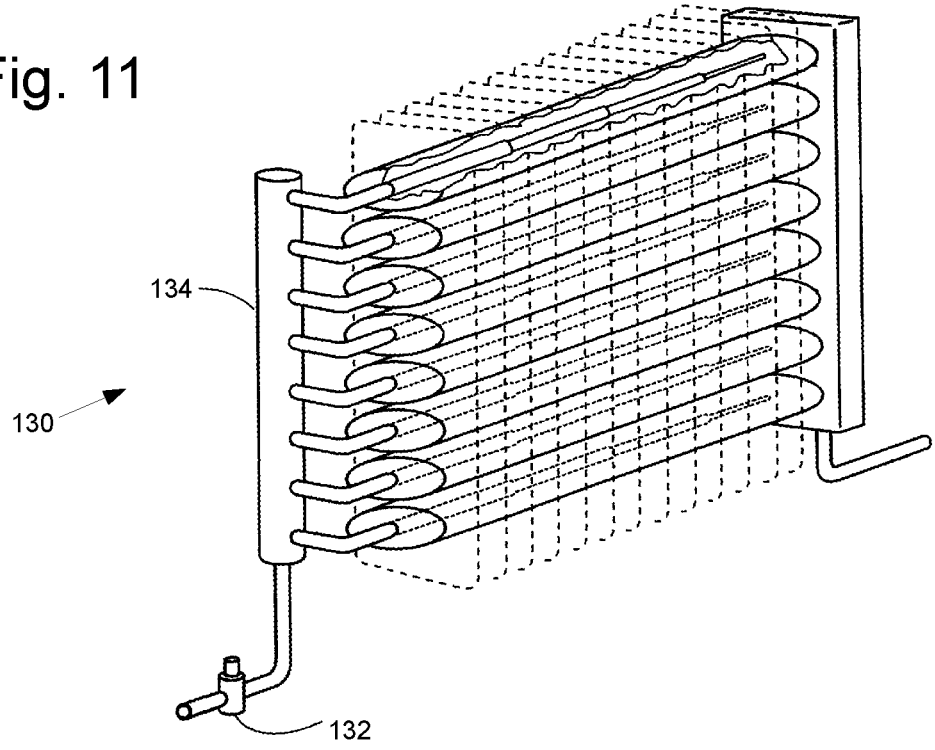
FIG. 11 is a perspective view of another alternative embodiment of an evaporator for a refrigerator system in accordance with the principles of the invention.

FIG. 11 shows another alternative embodiment of an evaporator 130 in accordance with the principles of the invention. This embodiment includes all the same features as the embodiment shown in FIG. 2. However, in this embodiment, an electronically modulating valve 132 controls flow into the inlet manifold 134. The modulating valve 132 allows an operator to reduce or increase the liquid refrigerant pressure in order to maintain the proper amount of refrigerant flow to match the load of refrigeration system.

Figure 12:
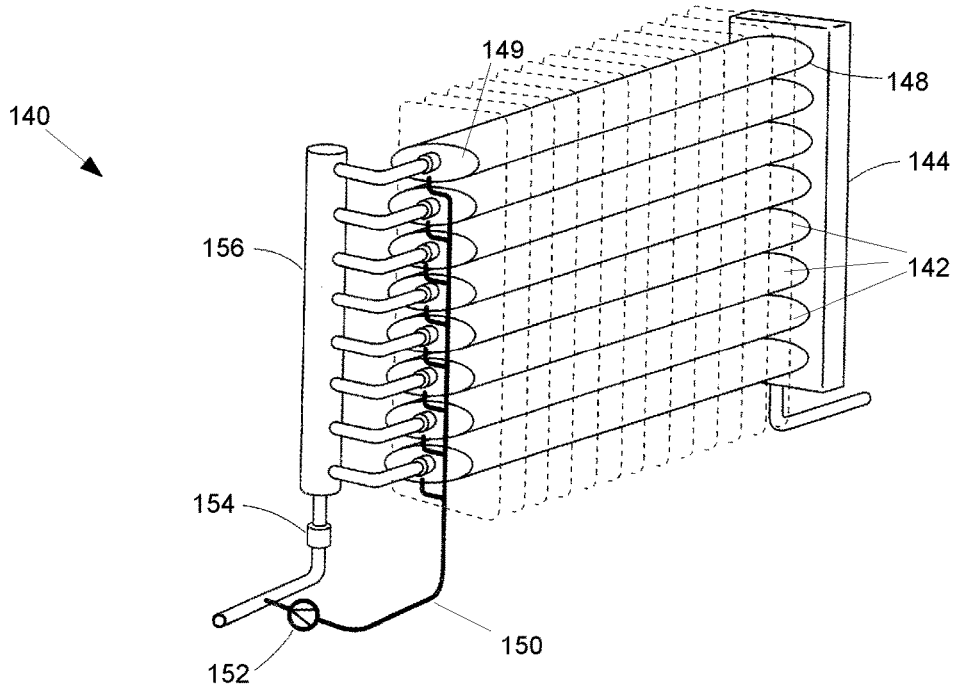
FIG. 12 is a perspective view of another alternative embodiment of an evaporator for a refrigerator system in accordance with the principles of the invention.

FIG. 12 shows another alternative embodiment of an evaporator 140 having a plurality of Coanda evaporation chambers 142. In this embodiment, the evaporator 140 includes all of the features of the embodiment shown in FIG. 11, and is also configured so that the flow of the refrigerant may be reversed, allowing the evaporator 140 optionally form the function of a condenser. The evaporator outlet manifold 144 now becomes the condenser discharge manifold and the discharge vapor will enter the Coanda evaporation chambers 142 through the vapor holes and oil holes in their distal ends 148. As the vapor condenses and converts to a liquid, the liquid refrigerant will exit the Coanda evaporation chambers 142 at their proximal ends 149 through a liquid outlet manifold 150 and then through a check valve 152 and into the liquid line. The control valve 154 will be closed during the heat pump mode to prevent discharge vapor from going backwards through the inlet manifold 156.

Figure 13:
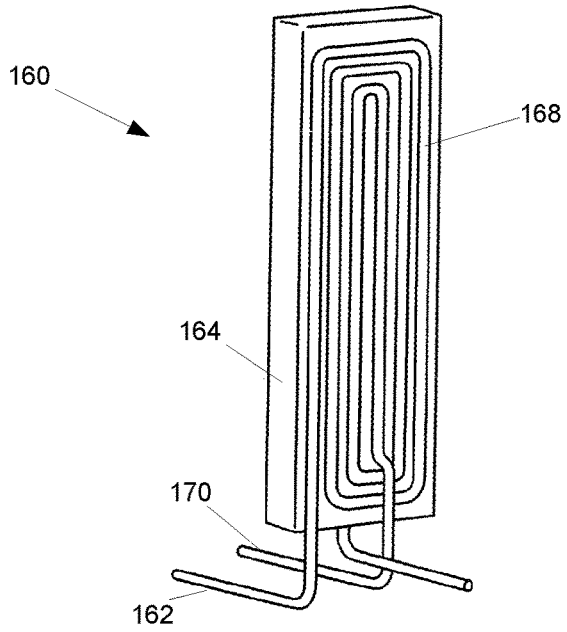
FIG. 13 is a perspective view of a plate heat exchanger affixed to an outlet manifold for an evaporator for a refrigeration system in accordance with principles of the invention.
Figure 14:
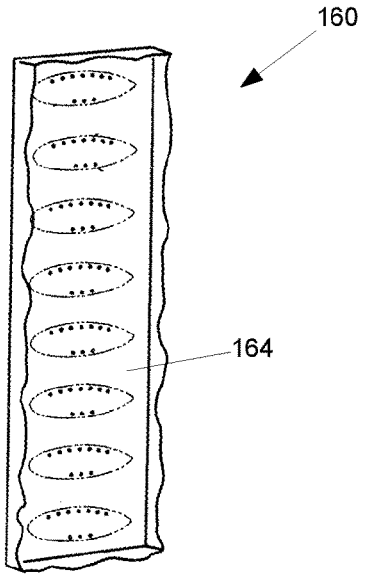
FIG. 14 is a cutaway view of an outlet manifold for an evaporator for a refrigeration system in accordance with principles of the invention.

FIGS. 13 and 14 show a plate heat exchanger 160 in accordance with the principles of the invention. The plate heat exchanger 160 is affixed to an outlet manifold 164 similar to those described in the other embodiments. The liquid line 162 from the condensor is bonded to the exterior wall of the outlet manifold 164. As the liquid refrigerant flows through the plate heat exchanger circuit 168 it will become sub cooled prior to entering the linear atomization tubes via subcooling outlet 170. The outlet manifold 164 may receive saturated droplets through the vapor holes and enter the interior wall of the header and vaporize as it hits the outside wall of the outlet manifold. The plate heat exchanger 160 will transfer heat from refrigerant in the plate heat exchanger 160 to refrigerant droplets inside the outlet manifold 164, thereby sub cooling the refrigerant before it is fed into the linear atomization tubes.

The present invention also includes a DRAD (Disc Refrigerant Atomization Design) which is a disc with thousands of holes that can be used as a retrofit for existing serpentine type or chamber style evaporators. The thousands of laser drilled holes in the disc provide individual pulse wave expansions that are propelled from the high pressure liquid into the evaporator circuit.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. An evaporator for a refrigeration system having an integrated expansion device comprising:

at least one elongate evaporator chamber having an airfoil-shaped cross section and extending between an inlet manifold at a proximal end and an outlet manifold at a distal end;

a plurality of vapor outlet holes near a top of the distal end of the evaporator chamber and a plurality of oil outlet holes near a bottom of the distal end of the evaporator chamber, wherein the outlet holes provide fluid communication between the evaporator and the outlet manifold;

a linear atomizer comprising a tube having a plurality of substantially evenly spaced holes extending through a center of the at least one elongate evaporator chamber;

a pulse injector feeding liquid refrigerant to the evaporator chamber in a series of rapid pulses;

wherein the airfoil-shaped cross section of the elongate evaporator chamber induces a Coanda effect on air blown across the elongate evaporation chamber by a fan.

2. The evaporator for a refrigeration system having an integrated expansion device of claim 1 wherein the linear atomizer has a progressively smaller diameter as it travels from the proximal end to the distal end of the at least one elongate evaporator chamber.

3. The evaporator for a refrigeration system having an integrated expansion device of claim 1 further comprising a plurality of fins on the exterior of the at least one elongate evaporator chamber perpendicular to a length of the at least one elongate evaporator chamber defined by the proximal end and the distal end of the elongate evaporator chamber.

4. The evaporator for a refrigeration system having an integrated expansion device of claim 1 wherein the distal end of the elongate evaporator chamber includes a plurality of vapor outlet holes near a top of the elongate evaporator chamber and a plurality of oil outlet holes near a bottom of the elongate evaporator chamber.

5. The evaporator for a refrigeration system having an integrated expansion device of claim 1 wherein the at least one elongate evaporator chamber comprises a plurality of the elongate evaporator chambers, each of which may be individually fluidly closed so that refrigerant cannot flow from the inlet and outlet manifolds.

6. The evaporator for a refrigeration system having an integrated expansion device of claim 1 further comprising an electronically modulating valve that controls flow into the inlet manifold, thereby allowing an operator to attenuate liquid refrigerant pressure in response to changes in a refrigeration system load.

7. The evaporator for a refrigeration system having an integrated expansion device of claim 1 wherein the refrigeration system includes a compressor and a condensor, said device interposed internally in evaporator and downstream from the condenser.

8. The evaporator for a refrigeration system having an integrated expansion device of claim 1 wherein the pulse injector is a pulse wave device operated by a piezo electric valve actuator capable of operating at cycles of less than one second.

9. The evaporator for a refrigeration system having an integrated expansion device of claim 1 wherein the outlet manifold includes a plate heat exchanger and said plate heat exchanger is capable of having liquid refrigerant pumped through the plate heat exchanger prior to entering the inlet manifold.

* * * * *